US005385674A

United States Patent [19]

Kupfer et al.

[11] Patent Number: 5,385,674

[45] Date of Patent: Jan. 31, 1995

[54] PROCESS FOR SEPARATION OF PETROLEUM EMULSIONS OF THE WATER-IN-OIL TYPE

[75] Inventors: Rainer Kupfer, Hattersheim; Martin Hille, Liederbach; Roland Böhm, Kelkheim; Friedrich Staiss, Wiesbaden, all of Germany

[73] Assignee: Hoechst Aktiengesellschaft, Frankfurt, Germany

[21] Appl. No.: 68,630

[22] Filed: May 27, 1993

[30] Foreign Application Priority Data

May 30, 1992 [DE] Germany ..... 4217985

[51] Int. Cl.[6] ..... B01D 17/05

[52] U.S. Cl. ..... 210/708; 210/735; 252/341; 252/344; 252/358

[58] Field of Search ..... 210/708, 735; 252/341, 252/344, 358

[56] References Cited

U.S. PATENT DOCUMENTS

| | | | |
|---|---|---|---|
| 3,009,884 | 11/1961 | Monson et al. | 252/341 |
| 4,734,523 | 3/1988 | Hofinger et al. | 560/196 |
| 4,885,110 | 12/1989 | Böse et al. | 252/341 |
| 4,885,111 | 12/1989 | Böse et al. | 252/344 |
| 5,114,616 | 5/1992 | Kupfer et al. | 210/358 |

FOREIGN PATENT DOCUMENTS

| | | |
|---|---|---|
| 0035263 | 9/1981 | European Pat. Off. . |
| 0267517 | 5/1988 | European Pat. Off. . |
| 0269887 | 6/1988 | European Pat. Off. . |
| 0333135 | 9/1989 | European Pat. Off. . |
| 3032216 | 4/1982 | Germany . |
| 9111242 | 8/1991 | Germany . |

*Primary Examiner*—Peter A. Hruskoci
*Attorney, Agent, or Firm*—Connolly and Hutz

[57] ABSTRACT

In the process described, esterification products of an oxyalkylated primary fatty amine and 0.5 to 1.5 mol per mole of fatty amine of a simple dicarboxylic acid or of a dicarboxylic acid from the group comprising dimeric fatty acids are employed as emulsion breakers.

10 Claims, No Drawings

PROCESS FOR SEPARATION OF PETROLEUM EMULSIONS OF THE WATER-IN-OIL TYPE

DESCRIPTION

The invention relates to a process for separation of petroleum emulsions of the water-in-oil type using ester products.

As is known, oil becomes watered down during petroleum production. The water carried along forms a water-in-oil emulsion with the oil. Salts, such as sodium chloride, calcium chloride and/or magnesium chloride, may be dissolved in the emulsified water. The water in the emulsion must be separated off before transportation of the oil produced to the refinery. In the refinery, before distillation, the salt content is decreased further by renewed formation of an emulsion with fresh water and demulsification. Too high a salt content in the crude oil could lead to malfunctions and corrosion in the refinery. A petroleum breaker, also called a demulgator or emulsion breaker, has the task of breaking the emulsion in the lowest possible concentration, and, during this separation process, effecting complete removal of the water and decreasing the salt content to a minimum without or with minimum additional use of heat. The quality criteria for the crude oil delivered are the residual salt and the water content.

Crude oils vary in composition according to their origin. Naturally occurring emulsion stabilizers have a complicated, differing chemical structure. To overcome their action, selective breakers have to be developed. Because of various production and processing conditions, the requirements imposed on a petroleum breaker are becoming even more diverse. As a result of the constant opening up of new petroleum fields and the change in production conditions of older petroleum fields, development of optimum demulsifiers remains an acute problem, and a large number of demulsifiers and demulsifier mixtures built up in various ways are required.

U.S. Pat. No. 4,734,523 and European Patent Application 0 333 135 A2 (Derwent Abstracts, Accession Number 89-271925/38) describes certain esterification products as petroleum breakers. The breakers of the U.S. patent are reaction products of an oxyalkylated primary fatty amine and a diol compound with a dicarboxylic acid, and those of the European patent application are reaction products of an oxyalkylated primary fatty amine and an adduct of a diol compound and a glycidyl ester with a dicarboxylic acid. Good and rapid removal of water and salt is achieved using these demulsifiers.

It has now been found that esterification products of an oxyalkylated primary fatty amine (as the sole component supplying OH groups) and a dicarboxylic acid are very effective petroleum breakers, and that this is the case in particular if the esterification product has been prepared from an oxyalkylated primary fatty amine and a dicarboxylic acid from the group comprising dimeric (dimerized) fatty acids.

The process according to the invention for separation of petroleum emulsions of the water-in-oil type accordingly comprises adding to the emulsions an effective amount of an esterification product of an oxyalkylated primary fatty amine of the following formula 1

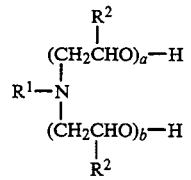

in which $R^1$ is an alkyl radical or alkenyl radical having 6 to 23 carbon atoms, $R^2$ is H or $CH_3$ and, arranged in blocks or randomly within the chain of the polyoxyalkylene radical, can also assume both meanings, and a and b are numbers from 2 to 30 in total, with the proviso that neither a nor b is zero, and 0.5 to 1.5 mol per mole of oxyalkylated primary fatty amine, preferably 0.5 to 1.1 mol per mole of oxyalkylated primary fatty amine, of a dicarboxylic acid, preferably of one from the group comprising dimeric fatty acids.

European Patent Application 0 035 263 A2 (Derwent Abstracts, Accession Number 68257D/38 ) and German Offenlegungsschrift 30 32 216 A1 (Derwent Abstracts, Accession Number 28817E/15) describe esterification products of an oxyalkylated primary fatty amine and a simple dicarboxylic acid, but these are recommended as textile softeners or hair treatment agents. There is no indication that such ester products would also be suitable as demulsifiers for any emulsion, or indeed for petroleum emulsions of the water-in-oil type, and the esterification products preferred according to the invention (that is to say those of an oxyalkylated primary fatty amine and a dimeric fatty acid as the dicarboxylic acid component) are not even mentioned in the two documents, and should rather be regarded as novel.

As regards the oxyalkylated primary fatty amines of the formula 1 mentioned, preferred amines are those in which $R^1$ is an alkyl radical having 8 to 18 carbon atoms or an alkenyl radical having 8 to 18 carbon atoms (it preferably contains 1 to 3 double bonds), $R^2$ is H and a and b are (identical or different) integers or fractions of 2 to 15 in total, taking into account the abovementioned proviso.

The oxyalkylation of primary fatty acids is well-known and can be carried out by one of the methods for oxyalkylation of compounds carrying acid (active) H atoms. The oxyalkylated fatty amines can contain units of ethylene oxide or propylene oxide, or units of ethylene oxide and propylene oxide randomly or in blocks, according to the meanings of $R^2$, the ethoxylated primary fatty amines, i.e. those containing only ethylene oxide units, being preferred. The fatty amines employed for the oxyalkylation can be individual primary fatty amines or mixtures thereof, according to the meanings of $R^1$. They can also be fatty amines in which the hydrocarbon chain contains one or more double bonds, such as the radicals of oleic, linoleic or linolenic acid. The preferred primary fatty amines are the industrially available products, such as stearylamine, coconut fatty amine or tallow fatty amine (alkyl radicals having essentially 8 to 18 carbon atoms are present in these industrial products).

Preferred dicarboxylic acids are those of the following formula 2 (i.e. simple dicarboxylic acids)

$$HOOC—R^3—COOH$$

in which $R^s$ is an alkylene radical of the formula $-(CH_2)_z-$, in which z is an integer from 1 to 10, preferably 4 to 8, and in which the alkylene radical can be substituted by 1 or 2 OH groups or by 1 or 2 $C_1$ to $C_{18}$-alkyl or $C_3$ to $C_{18}$-alkenyl, or is a vinylene radical or a p-phenylene radical, and those of the following formula 3 (i.e. dicarboxylic acids from the group comprising dimerized unsaturated $C_{18}$-fatty acids), $$HOOC-R^4-COOH$$

in which $R^4$ is a divalent hydrocarbon radical having 34 carbon atoms ($R^4$ is thus the radical containing 34 carbon atoms which is formed on dimerization of an unsaturated fatty acid having 18 carbon atoms to give a dicarboxylic acid having 36 carbon atoms in total).

As regards the preferred simple dicarbox-ylic acids, those which may be mentioned specifically are malonic acid, succinic acid, glutaric acid, adipic acid, pimelic acid and so on in the homologous series, and furthermore tartronic acid, malic acid and tartaric acid, as well as fumaric acid and maleic acid, and finally terephthalic acid. Particularly preferred simple dicarboxylic acids are those of the homologous series from adipic acid to sebacic acid, and furthermore maleic acid, fumaric acid, dodecylsuccinic acid and dodecenylsuccinic acid. It goes without saying that instead of these dicarboxylic acids, their anhydrides, halides or esters with lower alkanols can also be employed.

As a rule, dimeric fatty acids are prepared by addition polymerization (dimerization) of monounsaturated or polyunsaturated fatty acids. The number of carbon atoms and the structure of the resulting dicarboxylic acids essentially depends on the starting fatty acid and on the reaction conditions during the dimerization. Dimeric fatty acids of the most diverse nature and structure are commercially obtainable. Dimeric fatty acids which are preferred in the context of the present invention are those which are prepared by dimerization of unsaturated C18-fatty acids, for example of oleic acid, linoleic acid, linolenic acid or tallow fatty acid (as is known, dimerization is understood as meaning combination of two identical molecules to give a new molecule, the dimer, by an addition reaction). The dimerization of $C_{18}$-fatty acids is as a rule carried out at a temperature of 150° to 250° C., preferably 180° to 230° C., with or without a dimerization catalyst. The resulting dicarboxylic acid (i.e. the dimeric fatty acid) corresponds to the formula 3 shown, in which $R^4$ is the divalent linking member which is formed during dimerization of the $C_{18}$-fatty acid and carries the two —COOH groups and has 34 carbon atoms. $R^4$ is preferably an acyclic (aliphatic) or a mono- or bicyclic (cycloaliphatic) radical having 34 carbon atoms. The acyclic radical is as a rule a branched (substituted) and mono-, di- or triunsaturated alkyl radical having 34 carbon atoms. The cycloaliphatic radical in general likewise has 1 to 3 double bonds. The preferred dimeric fatty acids described are in general a mixture of two or more dicarboxylic acids of the formula 3 having structurally different $R^4$ radicals. The dicarboxylic acid mixture often has a higher or lower content of trimeric fatty acids which are formed during the dimerization and have not been removed during working-up of the product by distillation. Some dimeric fatty acids which are formed during dimerization of the $C_{18}$-fatty acids mentioned are shown by way of their formulae below, the hydrocarbon radical carrying the two —COOH groups being an acyclic, monocyclic or bicyclic radical:

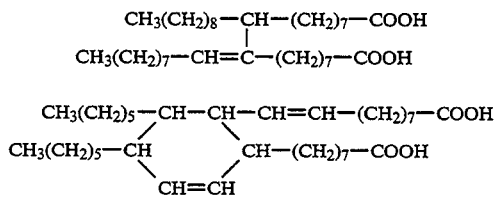

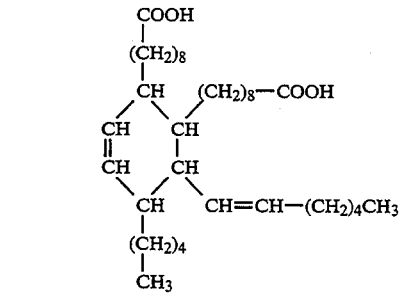

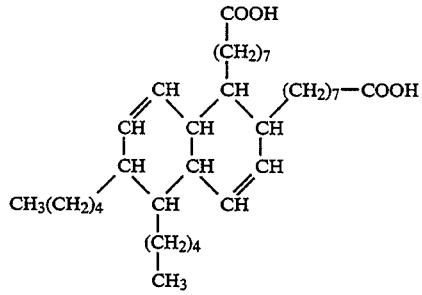

Of the dicarboxylic acids described, i.e. the simple dicarboxylic acids and the dimeric fatty acids, the latter are preferred; these are as a rule industrial products which are commercially obtainable under the name "dimerized fatty acids" or "dimeric fatty acids" and, as already mentioned above, can contain a larger or smaller content of trimerized fatty acids.

The esterification of the two reaction components, the oxyalkylated primary fatty amine and the dicarboxylic acid, is carried out in a ratio of 1 mol of fatty amine to 0.5 to 1.5 mol of dicarboxylic acid, preferably 0.5 to 1.1 mol of dicarboxylic acid. The esterification, which proceeds with polycondensation, can be carried out using a higher-boiling inert solvent, such as toluene, xylene or industrial aromatic cuts, or without a solvent in the melt and under cover of an inert gas, the procedure in solvents being preferred. In the case of esterification using a solvent, the reflux temperature of the reaction mixture is expediently chosen as the reaction temperature and the water of reaction formed is removed azeotropically. In the case of esterification in bulk, the water of reaction is distilled off directly from the reaction mixture. The reaction temperature is 100° to 220° C., preferably 130° to 200° C. To accelerate the reaction, as is expedient for esterification reactions, an alkaline or acid catalyst is used, acid catalysis using, for example, a hydrohalic acid, phosphoric acid, sulfuric acid, sulfonic acid or haloacetic acid as the catalyst being preferred. The course and the end of the reaction can be monitored with the aid of the water of reaction formed or by determination of the acid number. It is preferable to carry out the reaction up to an approximately 90 to 100% conversion, i.e. until essentially no further water of reaction is formed. To prepare the petroleum breaker according to the invention, a procedure should preferably be followed in which the two reaction components in the molar ratio stated and furthermore a solvent and an acid esterification catalyst are initially introduced into a reaction vessel, and this mixture is heated to 100° to 220° C., preferably 130° to 200° C., while stirring and passing through an inert gas, and is kept at this temperature with continuous discharge of the water formed (azeotropic distillation), until the reaction has ended. The resulting esterification product, which in general has an acid number of $<10$, preferably 2 to 8, can be purified from the catalyst employed by washing with water and is the petroleum breaker according to the invention. The reaction time is in the range from 5 to 20 hours. These esterification products are yellow- to brown-colored liquids of greater or lesser viscosity. They have a specific chemical structure, especially if a dimerized fatty acid is employed. Since they are preferably prepared in the presence of solvents, they are as a rule in the form of a concentrated solution (active compound content preferably 60 to 80% by weight).

The ester products proposed according to the invention (polyesters) are distinguished by a high demulsification action. At the usual petroleum processing temperatures, complete removal of the water and elimination of the salt content are already achieved after a short separation time. Crude petroleums for specific acceptance are thus obtained after a short separation time at the usual processing temperatures and using the petroleum-breakers. Moreover, they have the effect that the water separated off is practically free from oil, i.e. that complete removal of oil from the water separated off and therefore a good water quality are also achieved. Sharp separation between the oil and water phase is also achieved with these petroleum breakers, which is a further great advantage. The amount of demulsifier according to the invention employed can vary within wide limits. It depends in particular on the nature of the petroleum and on the processing temperature. The effective amount is in general 5 to 100 g per tonne, preferably 10 to 50 g per tonne. The breakers described are preferably employed in solution for the purpose of better metering and dispersibility. Suitable solvents are water or organic liquids, for example alcohols, such as methanol, isopropanol and/or butanol, and aromatic hydrocarbons, such as toluene and/or xylene or commercially available mixtures of higher aromatics.

The invention will now be explained in more detail by examples.

Preparation of the petroleum breakers described:

EXAMPLE 1

690 g (1.0 mol) of a tallow fatty amine which has been reacted with 10 mol of ethylene oxide, which is a fatty amine of the formula I where $R^1=C_{14}H_{29}$ (5%), $C_{16}H_{33}$ (30%) and $C_{18}H_{37}$ (65%), $R^2=H$ and $a+b=10$ (reaction component 1), and 146.1 g (1.0 mol) of adipic acid (reaction component 2) and 4.2 g of p-dodecylbenzenesulfonic acid, i.e. 0.5% by weight, based on the total weight of the two reaction components, as an esterification catalyst, are initially introduced into a reaction vessel equipped with a stirrer, water separator, reflux condenser and thermometer. The two reaction components are thus employed in a molar ratio of 1:1. 205 g of xylene, i.e. 25% by weight, based on the total weight of the two reaction components, are added as the solvent. The mixture is heated and is kept at a temperature of 130° to 140° C. for 2 hours, during which the reaction components react by esterification and the water of reaction distills off azeotropically. For after-reaction, the mixture is kept at a temperature of 160° to 170° C. for a further 10 hours. The course and the end of the esterification reaction are monitored by determination of the acid number. The esterification product obtained at a degree of reaction of 98% is a liquid having a viscosity of 1.1 Pa s.

EXAMPLE 2

Reaction components:
(1) Tallow fatty amine with 15 mol of ethylene oxide
( 2 ) Dodecenylsuccinic anhydride
Molar ratio of (1):(2)=1:0.5
Procedure as in Example 1
Degree of reaction 99%, viscosity 0.35 Pa s

EXAMPLE 3

Reaction components:
(1) Oleylamine with 5 mol of ethylene oxide
(2) Dimeric fatty acid (content of dimerized fatty acid: 98% by weight)
Molar ratio of (1):(2)=1:0.7
Procedure as in Example 1
Degree of reaction 95%, viscosity 2.1 Pa s

EXAMPLE 4

Reaction components:
(1) Tallow fatty amine with 10 mol of ethylene oxide
(2) Industrial dimeric fatty acid (content of dimerized fatty acid: 83% by weight, content of trimerized fatty acid: 17% by weight)
Molar ratio of (1):(2)=1:1.5
Procedure as in Example 1
Degree of reaction 97%, viscosity 3.4 Pa s

EXAMPLE 5

Reaction components:
(1) Coconut fatty amine with 6 mol of propylene oxide and 20 mol of ethylene oxide, arranged in blocks
(2 ) Maleic anhydride
Equivalent ratio of (1):(2)=1:1
Procedure as in Example 1
Degree of reaction 98%, viscosity 0.9 Pa s
Use of petroleum breakers of Examples 1 to 5:

The ester products of Examples 1 to 5 were employed for separating two different petroleum emulsions of the water-in-oil type. The results are summarized in the following Tables 1 and 2 and demonstrate the high efficiency of the breakers described.

TABLE 1

| | |
|---|---|
| Origin of the crude oil emulsion: | Alaska |
| Water content of the crude oil emulsion: | 22.4% by volume |
| Demulsification temperature: | 65° C. |
| Amount metered in: | 38 ppm |

| | Water separation in % by volume after . . . minutes | | | | | | Residual water content in % by weight |
|---|---|---|---|---|---|---|---|
| Example | 10 | 20 | 30 | 60 | 120 | 180 | in the oil phase |
| 1 | 49 | 70 | 83 | 94 | 99 | 100 | 0.18 |
| 2 | 28 | 68 | 93 | 99 | 100 | 100 | 0.32 |
| 3 | 25 | 26 | 41 | 98 | 99 | 100 | 0.15 |
| 4 | 12 | 46 | 82 | 96 | 98 | 100 | 0.12 |
| 5 | 51 | 72 | 88 | 89 | 100 | 100 | 0.25 |
| Blank | 0 | 0 | 0 | 0 | 0 | 0 | 7.58 |

TABLE 1-continued

| value |
|---|

TABLE 2

| | |
|---|---|
| Origin of the crude oil emulsion: | Saudi Arabia |
| Water content of the crude oil emulsion: | 28.4% by volume |
| Salt content of the crude oil emulsion: | 4.2% by weight |
| Demulsification temperature: | 38° C. |
| Amount metered in: | 18 ppm |

| | Water separation in % by volume after . . . minutes | | | | | | Residual salt content in ppm in |
|---|---|---|---|---|---|---|---|
| Example | 20 | 40 | 60 | 90 | 120 | 150 | the oil phase |
| 1 | 63 | 77 | 88 | 96 | 98 | 99 | 412 |
| 2 | 39 | 69 | 87 | 99 | 100 | 100 | 224 |
| 3 | 25 | 32 | 48 | 87 | 99 | 100 | 278 |
| 4 | 74 | 87 | 96 | 99 | 100 | 100 | 166 |
| 5 | 34 | 42 | 81 | 96 | 98 | 99 | 455 |
| Blank value | 0 | 0 | 0 | 0 | 0 | 0 | 14 735 |

We claim:

1. A process for separation of a petroleum emulsion of the water-on-oil type, which comprises adding to the emulsion an effective amount of an esterification product of the components consisting essentially of an oxyalkylated primary fatty amine component of the following formula 1

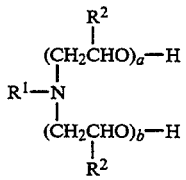

in which $R^1$ is an alkyl radical or alkenyl radical having 6 to 23 carbon atoms, $R^2$ is H, $CH_3$, or H and $CH_3$ within the chain of the polyoxyalkylene radical, arranged in blocks or randomly, and a and b are numbers from 2 to 30 in total, with the proviso that neither a nor b is zero, and 0.5 to 1.5 mol, per mole of oxyalkylated primary fatty amine, of a dicarboxylic acid component; and separating the emulsion to an oil phase and a water phase.

2. The process as claimed in claim 1, wherein the esterification product is a product of the components consisting essentially of the oxyalkylated primary fatty amine component and 0.5 to 1.5 mol, per mole of fatty amine, of a dicarboxylic acid component of the following formula 2

$$HOOC—R^3—COOH$$

in which $R^3$ is an alkylene radical of the formula $—(CH_2)_z—$, in which z is an integer from 1 to 10, or is a vinylene radical or a p-phenylene radical, or of a dicarboxylic acid component comprising a dimeric fatty acid.

3. The process as claimed in claim 2, wherein the alkylene radical of the formula $—(CH_2)_z—$ is substituted by 1 or 2 OH groups or by 1 or 2 $C_1$ to $C_{18}$-alkyl or $C_3$ to $C_{18}$-alkenyl.

4. The process as claimed in claim 1, wherein the esterification product is a product of the components consisting essentially of an oxyalkylated primary fatty amine component of the formula 1, in which $R^1$ is an alkyl radical having 8 to 18 carbon atoms or an alkenyl radical having 8 to 18 carbon atoms, $R^2$ is H and a and b are numbers from 2 to 15 in total, and 0.5 to 1.5 mol, per mole of fatty amine, of a dicarboxylic acid component of the following formula 2

$$HOOC—R^3—COOH$$

in which $R^3$ is an alkylene radical of the formula $—(CH_2)_z—$, in which z is an integer from 1 to 10, or is a vinylene radical or a p-phenylene radical, or of a dicarboxylic acid component comprising a dimeric fatty acid of the following formula 3

$$HOOC—R^4—COOH$$

in which $R^4$ is a divalent hydrocarbon radical having 34 carbon atoms.

5. The process as claimed in claim 4, wherein the alkylene radical of the formula $—(CH_2)_z—$ is substituted by 1 or 2 OH groups or by 1 or 2 $C_1$ to $C_{18}$-alkyl or $C_3$ to $C_{18}$-alkenyl.

6. The process as claimed in claim 1, wherein the esterification product is a product of the components consisting essentially of an oxyalkylated primary fatty amine component of the formula 1 in which $R^1$ is an alkyl radical having 8 to 18 carbon atoms or an alkenyl radical having 8 to 18 carbon atoms, $R^2$ is H and a and b are numbers from 2 to 15 in total, and 0.5 to 1.5 mol, per mole of fatty amine, of a dicarboxylic acid of the formula $HOOC—(CH_2)_z—COOH$, in which z is an integer from 4 to 8, or of a dicarboxylic acid component comprising a dimeric fatty acid of the following formula 3

$$HOOC—R^4—COOH$$

in which $R^4$ is a divalent hydrocarbon radical having 34 carbon atoms.

7. The process as claimed in claim 1, wherein the esterification product is a product of the components consisting essentially of the oxyalkylated primary fatty amine and 0.5 to 1.5 mol, per mole of fatty amine, of a dicarboxylic acid comprising a dimeric fatty acid.

8. The process as claimed in claim 1, wherein the esterification product is a product of the components consisting essentially of the oxyalkylated primary fatty amine and 0.5 to 1.5 mol per mole of fatty amine of a dicarboxylic acid comprising a dimeric fatty acid of the following formula 3

$$HOOC—R^4—COOH$$

in which $R^4$ is a divalent hydrocarbon radical having 34 carbon atoms.

9. The process as claimed in claim 1, wherein the esterification product is a product of the components consisting essentially of an oxyalkylated primary fatty amine of the formula 1, in which $R^1$ is an alkyl radical having 8 to 18 carbon atoms or an alkenyl radical having 8 to 18 carbon atoms, $R^2$ is H and a and b are numbers from 2 to 15 in total, and 0.5 to 1.5 mol, per mole of fatty amine, of a dicarboxylic acid component comprising a dimeric fatty acid of the following formula 3

$$HOOC—R^4—COOH$$

in which $R^4$ is a divalent hydrocarbon radical having 34 carbon atoms.

10. The process as claimed in claim 1, wherein the esterification product is formed from essentially 0.5 to 1.1 mol of dicarboxylic acid per mole of fatty amine.

* * * * *